United States Patent [19]

May

[11] 4,350,338

[45] Sep. 21, 1982

[54] FOOTBALL PRACTICE AID

[76] Inventor: Randall L. May, 8312 Seaport Dr., Huntington Beach, Calif. 92646

[21] Appl. No.: 131,385

[22] Filed: Mar. 17, 1980

[51] Int. Cl.[3] ..... A63B 67/00

[52] U.S. Cl. ..... 273/55 B; 273/58 C

[58] Field of Search ..... 273/55 R, 55 B, 58 C, 273/26 E, 185 C, 185 D, 26 EA, 196, 198, 200 R, 319, 321, 332, 334, 413, 414, 65 A, 65 R, 65 EG, 29 A; 46/61

[56] References Cited

U.S. PATENT DOCUMENTS

| | | | |
|---|---|---|---|
| 289,221 | 11/1983 | Clark | 273/58 C |
| 3,709,491 | 1/1973 | Minchin | 273/58 C |
| 3,804,409 | 4/1974 | Schochner | 273/55 B |
| 3,830,504 | 8/1974 | Koo | 273/185 C |

FOREIGN PATENT DOCUMENTS

| | | | |
|---|---|---|---|
| 2633172 | 1/1978 | Fed. Rep. of Germany | 273/58 C |

*Primary Examiner*—Richard C. Pinkham
*Assistant Examiner*—T. Brown
*Attorney, Agent, or Firm*—Neal J. Mosely

[57] ABSTRACT

A football practice aid consists of a special harness arrangement for use with a regulation little league, junior high school, high school, college or professional type football. The harness comprises a plurality of non-elastic cords of a size to fit into and be recessed in the seams of the football which extend from end to end thereof. The harness is preferably slightly undersized and is installed on the football prior to inflation so that the football when inflated is very tightly encompassed by the harness. The harness is connected to one or more spinners which permit complete rotation during use. The spinners are connected to and in a non-elastic cord which in turn is connected to an elastic supporting member which is secured on a supporting post or stake or the like. This harness permits use of the football for practice passing and practice punting and allows complete spin of the ball around its longitudinal axis while in use. The elastic supporting member is effective to cause the ball to be returned automatically after reaching the maximum extent of the non-elastic cord and the elastic supporting member. The return of the ball is accomplished with a full natural spin with the result that the ball will have the same characteristics when caught as would be obtained if the ball were passed or punted by another player and then caught.

12 Claims, 10 Drawing Figures

FOOTBALL PRACTICE AID

BACKGROUND OF THE INVENTION

1. Field of the Invention

This invention relates to new and useful improvements in football practice aids and more particularly to a device whereby a football may be passed or punted and will automatically return to the player.

2. Brief Description of the Prior Art

In the practice of the game of football, particularly in the passing and punting phases thereof, it is desirable to have the ball returned to the player without the necessity of having another party retrieve the ball or having the player retrieve the ball himself. It is also desirable sometimes to practice punting or passing of a football in confined space either indoors or adjacent to a playing field where the extent of movement of the ball must be restricted. There are numerous devices which have been designed for returning balls of various types to a player during practice.

Quin U.S. Pat. No. 1,502,058 discloses a rubber ball having a cord for retrieval during practice.

Ferguson U.S. Pat. No. 4,071,239 discloses a tennis racket with a practice ball tethered thereto.

Tapp U.S. Pat. No. 3,351,343 discloses a practice ball which is spherical in shape and which has wide straps surrounding the ball and tethered for purpose of recovering the ball during practice.

Minchin U.S. Pat. No. 3,709,491 discloses a wide harness for fitting around a ball which is to be tethered for ease of recovery during practice.

Moore U.S. Pat. No. 4,147,353 discloses a harness for a spherical soccer ball connected to a tether for recovery of the ball during practice.

Pruitt U.S. Pat. No. 3,227,450 discloses a wide elastic band fastened around a football and connected by elastic cords to stakes in the ground, the arrangement probiding for return of the ball during kicking practice.

Bellagamba U.S. Pat. No. 3,525,523 discloses another kicking practice tether for a football having the tether fastened to the laces of the football and connected to an elastic cord supported on stakes in the ground.

Masters U.S. Pat. No. 3,042,404 discloses a specially designed football having an end loop connected to an elastic tether supported on a headband on a player using the ball in practice.

Civita U.S. Pat. No. 3,940,133 discloses a specially designed football of plastic foam construction which is connected to a tether for recovery during practice.

Schachner U.S. Pat. No. 3,804,409 discloses a specially designed football having a connector supported inside the cover of the ball and held in place by the laces of the ball and connected to a tether for recovery of the ball during practice kicking.

The several prior art patents listed above all suffer from the defect that they either require the use of specially designed, non-regulation balls, or have connecting means or tethering means which are connected to the ball in a manner preventing the normal handling of the ball. The devices shown in the above noted patents do not permit the handling of an unobstructed regulation football during practice and are not connected to the tethering apparatus in a manner permitting free rotation of the ball about its longitudinal axis and effecting return of the ball with a spin corresponding to that encountered when the ball is passed or punted by one player and caught by another.

SUMMARY OF THE INVENTION

One of the objects of this invention is to provide a new and improved football practice aid which permits normal handling of a regulation football in passing and punting practice and returns the ball to the player using the same.

Another object of this invention is to provide a new and improved football practice aid comprising an improved football harness which does not interfere with the normal handling characteristics of a regulation football and is connected to elastic means for returning the ball after punting or passing.

Still another object of this invention is to provide a new and improved football practice aid which facilitates passing or punting practice and permits normal handling of a regulation ball and free rotation of the ball around its longitudinal axis during practice and which returns the ball after punting or passing with a spin corresponding substantially to the spin produced in punting or passing.

Other objects of this invention will become apparent from time to time throughout the specification and claims as hereinafter related.

The foregoing objects are accomplished in this invention by a football practice aid comprising a novel supporting harness for a regulation football and tethering equipment associated therewith. A football practice aid consists of a special harness arrangement for use with a regulation little league, junior high school, high school, college or professional type football. The harness comprises a plurality of non-elastic cords of a size to fit into and be recessed in the seams of the football which extend from end to end thereof. The harness is preferably slightly undersized and is installed on the football prior to inflation so that the football when inflated is very tightly encompassed by the harness. The harness is connected to one or more spinners which permit complete rotation during use. The spinners are connected to and in a non-elastic cord which in turn is connected to an elastic supporting member which is secured on a supporting post or stake or the like. This harness permits use of the football for practice passing, catching and practice punting and allows complete spin of the football around its longitudinal axis while in use. The elastic supporting member is effective to cause the ball to be returned automatically after reaching maximum extent of the non-elastic cord and the elastic supporting member. The return of the ball is accomplished with a full natural spin with the result that the ball will have the same characteristics when caught as would be obtained if the ball were passed or punted by another player and then caught.

DESCRIPTION OF THE PREFERRED EMBODIMENT

Figure 1:
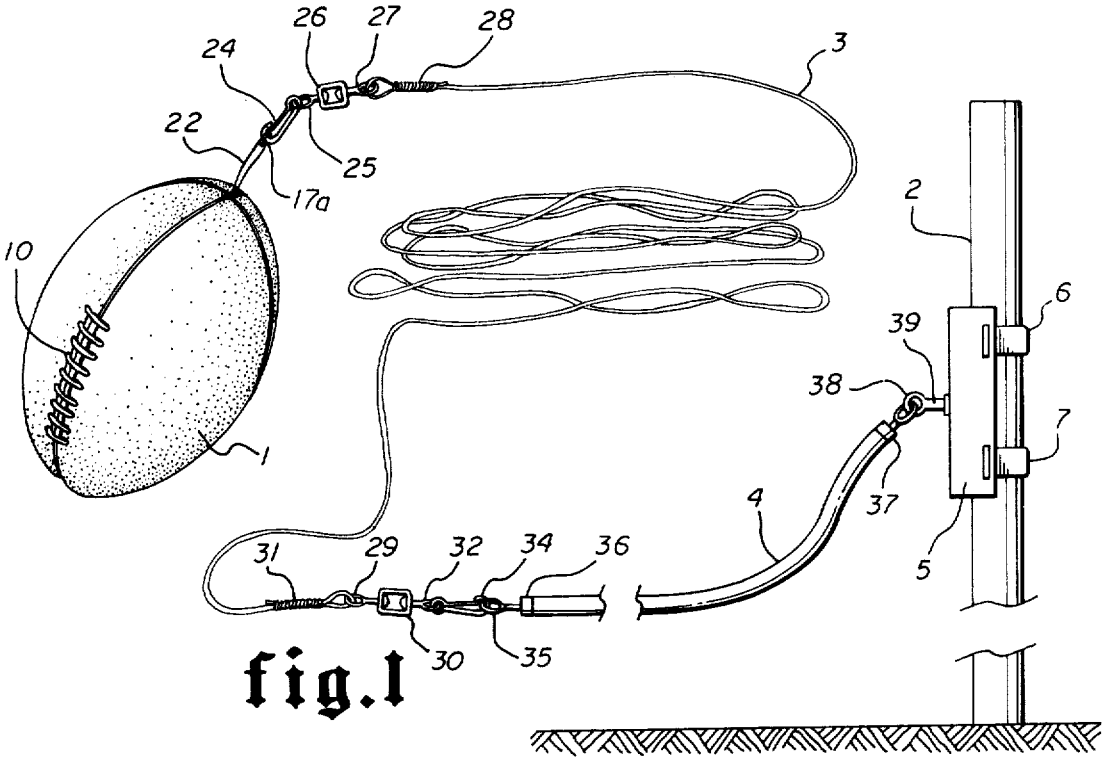
FIG. 1 is a view of a preferred embodiment of a football practice aid constructed and used in accordance with this invention.

Referring to the drawings by numerals of reference and more particularly to FIG. 1, there is shown a football 1 which is tethered to a supporting post or stake 2 or the like. Football 1 is a regulation little league, junior high school, high school, college or professional football. Supporting post or stake 2 may be any suitable support including a goalpost, utility pole, etc.

Football 1 is supported on a non-elastic cord 3 which in turn is secured on an elastic supporting member 4 which is secured on a bracket 5 which is held on supporting post or stake 2 by straps 6 and 7. Various details of this football practice aid will be described in connection with the individual detail view shown in FIGS. 3–10.

Figure 2:
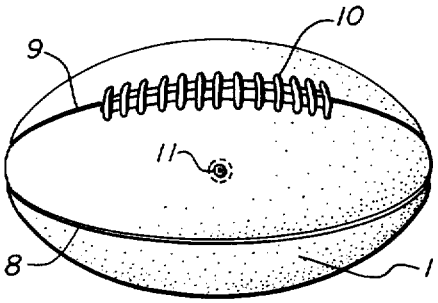
FIG. 2 is an isometric view of a regulation little league, junior high school, high school, college or professional football.

In FIG. 2, it is seen that football 1 is a regulation football having a plurality of grooves spaced 90° apart and extending from end to end. The grooves are defined by seams 8 and 9 and the corresponding unnumbered seams on the opposite side of the football as seen in FIG. 2. The ball is provided with the usual laces 10 and has an opening 11 for receiving a needle valve or the like for inflation.

Figure 1A:
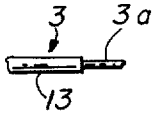
FIG. 1*a* is a view of a portion of the non-elastic filament used, with the wire core exposed.
Figure 4:
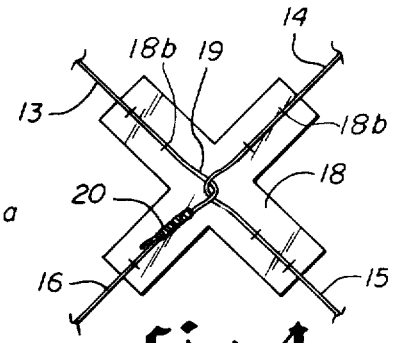
FIG. 4 is a detail view of the left end of the harness shown in FIG. 3.
Figure 3:
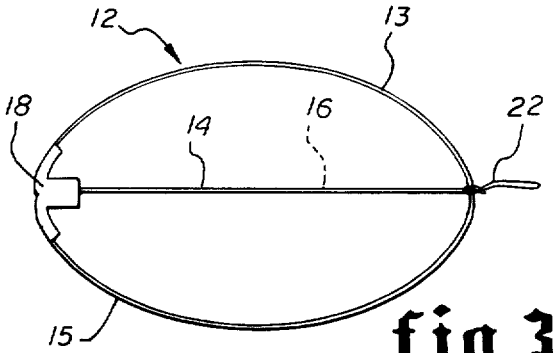
FIG. 3 is a view in elevation of a harness constituting part of a preferred embodiment of this invention for use with a football as shown in FIG. 2.
Figure 5:
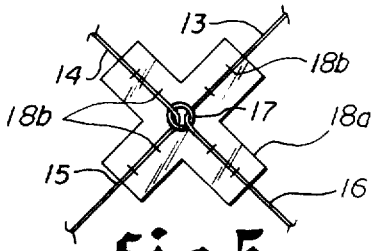
FIG. 5 is a detail view of the right end of the harness shown in FIG. 3 without the supporting connecting loop.

Football 1 is surrounded by a supporting harness 12 which is constructed of a non-elastic cord. The cords which make-up harness 12 are a non-elastic in the sense that a steel wire is non-elastic. They are non-elastic in the sense that they undergo only a minute deformation or stretch under ordinary tensions. This is to be distinguished from an elastic cord such as rubber or plastic. The harness 12 is preferably formed of a continuous cord which is preferably 80 lb. test Steelon. Steelon is a fine steel wire inside an extruded nylon filament (see FIG. 1*a* filament 3, 13, 14, 15 or 16 with wire core 3*a* exposed). The non-elastic cord in harness 12 is non-elastic in the sense that steel wire is non-elastic, i.e. does not stretch appreciatably under tension, as compared to a rubber or plastic unreinforced cord. The non-elastic cord which makes-up harness 12 is preferably a single continuous length of cord which is formed into four separate loops which fit into the respective grooves 8 and 9 (and the unnumbered grooves on the opposite side of the football 1) with one of the loops extending under the laces 10 of football 1. The individual loops of harness 12 are of a size which fits tightly into the grooves formed by the seams of the football 1 and are substantially recessed therein. While the individual loops of harness 12 constitute a continuous length of cord, these loops are numbered 13, 14, 15 and 16, respectively. At the right end of FIG. 3, it is seen that the loops of harness 12 extend through a small grommet 17 with loops 13 and 15 extending under the grommet 17 and loops 14 and 16 extending over grommet 17. This arrangement when tightened on the right end of football 1 would cause grommet 17 to fit tightly and flatly against the end of the football. At the left end of the harness 12 as shown in FIG. 3, it is seen that the individual loops of the non-elastic cord extend through slits 18*b* in an end boot 18 and are interlooped as indicated at 19. The ends of loops 13 and 16 are tied together as indicated at 19 and the wire tightly twisted and preferably fused by heating the nylon coating. The harness 12 is preferably formed in an initial size which would fit very tightly inside the grooves formed by seams 8 and 9 of football 1. Harness 12 is preferably slightly undersized in relation to the dimensions of football 1 to insure that it fits tightly thereon. Harness 12 is assembled on football 1 by deflating football 1 and then fitting harness 12 in place and reinflating the ball. As previously noted, during installation of harness 12, one of the non-elastic loops, e.g. loop 13, is assembled on groove 9 and extends under the laces 10 on football 1.

Figure 6:
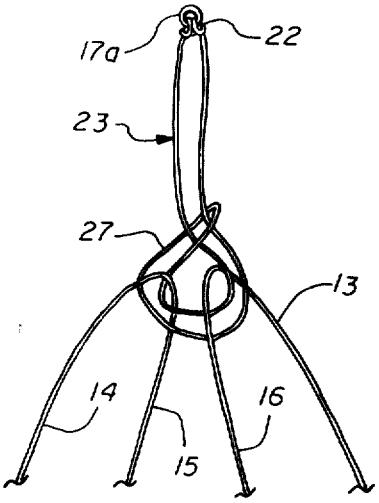
FIG. 6 is a detail view of the connection of the supporting loop to the ends of the harness shown in FIG. 5.
Figure 7:
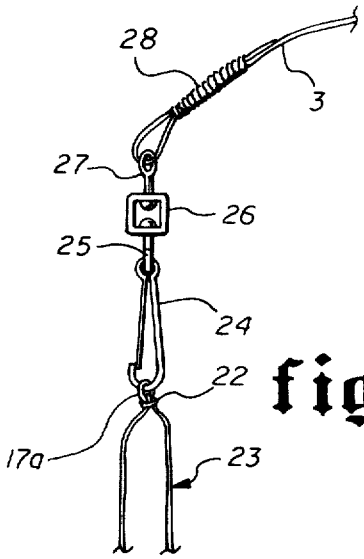
FIG. 7 is a detail view showing the connection of the supporting loop of FIG. 6 to the end of the supporting cord for the tether.

In FIG. 6, there is shown an enlarged or exaggerated view of the non-elastic loops 13–16 at the right end of harness 12 with grommet 17 removed. FIG. 6 illustrates the connection of harness 12 to the tethering cord. There is shown a loop of a strong, soft, knitted or woven non-elastic cord 22 which is looped through the ends of harness 12 and looped through itself providing a connecting loop for connection on grommet 17*a* on the tethering cord. The loop of the soft woven or knitted cord 22 is secured to itself by a knot or other suitable connecting means. Loop 22 is shown in FIG. 7 to be connected to ring 17*a* which, in turn, is connected to snap hook 24 on ring 25 extending from one side of spinner 26. The other side of spinner 26 is provided with a ring 27 in which there is looped a portion of non-elastic cord 3 which is twisted around itself as indicated at 28 and secured by a suitable clamping or securing means. The cord 3 may be secured at 28 by heating to fuse the nylon coating of the steel wire in the cord or may be secured by any suitable external clamp or retainer. Cord 3 is a non-elastic cord and is preferably 400 lb. test woven nylon cord or extruded nylon filament.

Figure 8:
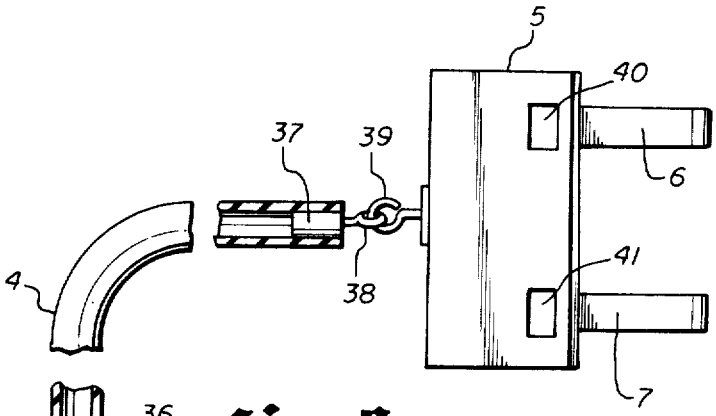
FIG. 8 is a detail view of the bracket for supporting the tether on a post or stake of the like and further illustrates the elastic supporting member to which the tether cord is secured.
Figure 9:
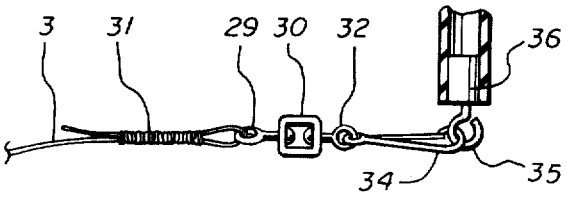
FIG. 9 is an end view of the supporting bracket of FIG. 8.
Figure 9:
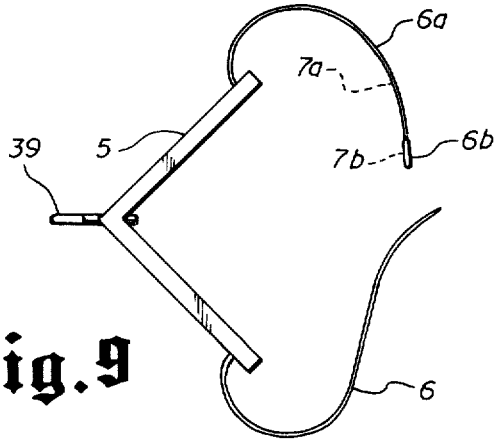
Figure 10:
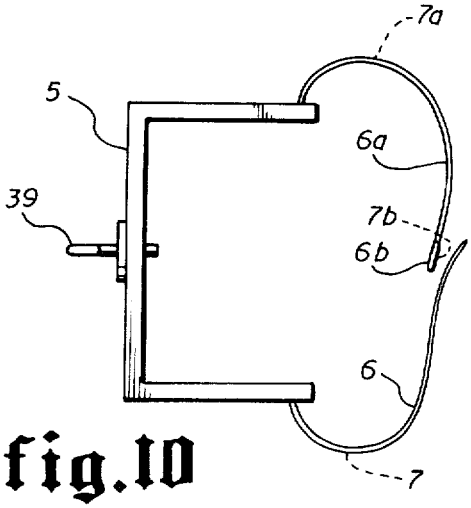
FIG. 10 is an end view of an alternate embodiment of the supporting bracket of FIG. 8.

In FIG. 8, it is seen that the other end of cord 3 is connected to loop or ring 29 on spinner 30. Cord 3 extends through loop 29 and is rewound on itself as indicated at 31 where it is secured in place by fusing the nylon coating or by application of a suitable external clamp. The other side of spinner 30 has a securing ring 32 which is secured on the ring 33 at the base of snap hook 34. Non-elastic cord 3 is fastened by means of snap hook 34 to ring 35 which is secured in a plug 36 which is tightly fitted in the elastic supporting member 4. Elastic supporting member 4 is a strong elastic tubing, preferably a surgical rubber or plastic tubing. The tubing used is preferably about two feet long and has an I.D. of 3/16" and an O.D. of 7/16". Plug 36 is preferably a piece of nylon rod having an O.D. of ¼". The other end of elastic tubing 4 has a plug 37 secured therein and which supports a ring 38 which is connected on the ring 39 extending from supporting bracket 5. Ring 38 is preferably a snap hook for ease of assembly. Bracket 5 is provided with slots 40 and 41 in which there are supported straps 6 and 7, respectively. In FIGS. 9 and 10, there are shown end views of bracket 5 into alternate forms. In FIG. 9, bracket 5 is shown as constructed from angle iron or the like. In FIG. 10, bracket 5 is shown to have a channel-shaped construction. In each of FIG. 9 and 10, it is seen that straps 6 and 7 are connectable to straps 6*a* and 7*a* having buckles 6*b* and 7*b*, respectively.

OPERATION

In normal operation, this football practice aid would be used by fastening bracket 5 to a pole or post 2, or the like, by means of straps 6 and 7. Pole 2 may be any suitable support such as goalposts, telephone and utility poles or the like.

Football 1 is used, as indicated, supported in harness 12. Since non-elastic cords 13–16 are very strong and very small diameter, they fit in grooves 8 and 9 (and the unnumbered grooves on the other side of the ball) which are formed by the seams of the ball. Cords 13–16 are recessed into grooves 8 and 9 (and the other grooves) and do not extend appreciably above the surface of the ball. Preferably, the cords of harness 12 are completely recessed into grooves 8 and 9. With this construction of harness 12, ball 1 can be handled for practice without any interference from the supporting harness. The ball can be used for practice passing, receiving and punting. Since the harness fits inside the grooves or seams of the football it does not interfere with the aerodynamic characteristics of a regulation football. The ball will have the normal rotation when it is passed or punted and will extend in practice for the entire length of the non-elastic cord 3. When the ball 1 is thrown or kicked and reaches the limit of movement of non-elastic cord 3 the elastic tubing (or other suitable elastic support) 4 will stretch and limit the forward movement of the ball. At that point, the elastic 4 will pull the ball backward with sufficient force to cause it to return to the player along approximately the same areal path as the path on which it was passed or punted. In fact, the arrangement of non-elastic cord 3 and elastic tubing 4 and the various supporting members is effective to cause the ball to maintain a normal spin or rotation as it is being returned to the player that is practicing with it. The spinners 26 and 30 which are provided in the connection between the harness 12 and elastic tubing 4 are of a construction which permit free and substantially unobstructed rotation to a full 360°, or more, rotation.

This football practice aid differs from prior art practice aids for football in a number of respects and has several advantages which have previously been observed. The harness fits to the configuration of any regulation little league, junior high school, high school, college or professional football. The harness cords fit inside or recessed in the seams or grooves of the football and one of the cords passes not only along the groove but also under the laces 10 of the ball. The retaining boots 18 and 18*a* at the ends of the football 1 fit the end of the ball closely and do not interfere with the aerodynamic characteristics of the ball. There is no obstruction when gripping the ball and the player is handling a ball of regulation size and shape with no external harness or support which will alter the feel of the ball in practice. In passing, catching and punting the ball is handled and used with no external obstruction. The ball can spin freely through the entire path of travel when passed or punted and retains the spin when it is pulled back to the player by the elastic tubing 4. The rotation of the ball when it is launched is completely natural and corresponds to the natural or normal rotation of the ball when passed or punted. When the ball returns the rotation is the natural or normal rotation of a ball coming to a receiver. This practice aid is therefore effective for passing and for punting and for catching or receiving a passed or punted ball. Also, the ball can be disconnected and used in regular practice or play without removing the harness.

While this invention has been described fully and completely with special emphasis upon a single preferred embodiment, it should be understood that within the scope of the appended claims this invention may be practiced otherwise than as specifically described herein.

I claim:

1. The combination of a football practice aid with a regulation little league, junior high school, collegiate or professional football having four equally spaced grooves defined by seams extending longitudinally thereof, said practice aid comprising a harness comprising four equally spaced non-elastic cords operatively secured each to another at opposite ends thereof and supported tightly in the grooves of said football and substantially recessed therein, tether means comprising a non-elastic cord operatively secured at one end to the portion of said harness where said four cords are secured together and positioned at one end of said football at the longitudinal axis thereof, means connected to said cord permitting spin or rotation of said football about its longitudinal axis or otherwise without twisting the same, an elastic supporting member operatively secured at one end to the other end of said non-elastic cord, and a support member operatively secured to the other end of said elastic member and operable to be supported on a support fixed in the earth, and said practice aid being operable to permit said football to be passed or punted with a normal spin and to be returned by said elastic member to the player using the same.

2. A football practice aid combination according to claim 1 in which said spin permitting means includes at least one spinner connected in said tether means.

3. A football practice aid combination according to claim 2 in which said tether means includes spinners supported on opposite ends of said tether non-elastic cord.

4. A football practice aid combination according to claim 1 in which said support member comprises a member having two walls meeting in a right dihedral angle, and straps positioned in said walls operable to secure said member to said fixed support.

5. A football practice aid combination according to claim 1 in which said support member comprises a member of channel shape with the side walls thereof having supported thereon straps positioned in said walls operable to secure said member to said fixed support.

6. A football practice aid combination according to claim 1 in which said elastic supporting member comprises an elastic tubing with plugs in each end having support members connected to said first named support member and said non-elastic cord respectively.

7. A football practice aid combination according to claim 1 in which said harness includes a ring member in which said cords are looped and operable to fit one end of said football at the longgitudinal axis thereof, and the cords at the opposite end of said harness from said ring member being interlooped and tied together with said interlooped end being operable to fit the opposite end of said football at the longitudinal axis thereof.

8. A football practice aid combination according to claim 7 in which said harness includes a supporting boot having substantially the configuration of the end of said football and having openings through which said harness cords are threaded and supporting said interlooped portion.

9. A football practice aid combination according to claim 7 in which said harness includes a soft non-elastic cord interlooped through the ends of said harness cords looped through said ring member and operable to support said harness at the longitudinal axis of said football when assembled thereon, and one end of said soft non-elastic cord being secured to the non-elastic cord of said tether means.

10. A football practice aid combination according to claim 7 in which said harness cords are looped through said ring member so that one pair of oppositely extending cords are looped over the same and one pair of oppositely extending cords are looped under the same to secure said ring member firmly against one end of said football when assembled thereon.

11. A football practice aid combination according to claim 1 in which said non-elastic cords comprise an extruded plastic monofilament having a continuous length of metal wire as a core.

12. A football practice aid combination according to claim 1 in which the cords of said harness are supported in said grooves with one cord positioned underneath the laces of said football.

* * * * *